US010487409B1

(12) United States Patent
Diebold et al.

(10) Patent No.: US 10,487,409 B1
(45) Date of Patent: Nov. 26, 2019

(54) ELECTROLYSIS APPARATUS, SYSTEM, AND METHOD FOR PRODUCING CHLORINE BLEACH

(71) Applicant: Edge Outreach, Inc., Louisville, KY (US)

(72) Inventors: Frank Diebold, Louisville, KY (US); Joseph Jacobi, Louisville, KY (US); David Mekus, Louisville, KY (US)

(73) Assignee: Edge Outreach, Inc., Louisville, KY (US)

( * ) Notice: Subject to any disclaimer, the term of this patent is extended or adjusted under 35 U.S.C. 154(b) by 3 days.

(21) Appl. No.: 15/961,577

(22) Filed: Apr. 24, 2018

Related U.S. Application Data

(60) Provisional application No. 62/489,788, filed on Apr. 25, 2017.

(51) Int. Cl.
*C25B 1/26* (2006.01)
*C25B 9/06* (2006.01)

(52) U.S. Cl.
CPC . *C25B 1/26* (2013.01); *C25B 9/06* (2013.01)

(58) Field of Classification Search
CPC ..... C25B 1/24; C25B 9/06; C02F 1/4674
See application file for complete search history.

(56) References Cited

U.S. PATENT DOCUMENTS 5,611,907 A * 3/1997 Herbst ..... C02F 1/46104 204/237
5,858,201 A * 1/1999 Otsuka ..... A01N 59/00 205/701
9,150,437 B2 * 10/2015 Hermann ..... C02F 1/4672

* cited by examiner

*Primary Examiner* — Arun S Phasge
(74) *Attorney, Agent, or Firm* — Stites & Harbison, PLLC; David W. Nagle, Jr.; James R. Hayne

(57) ABSTRACT

An electrolysis apparatus for producing chlorine bleach includes an anode plate, a cathode plate spaced apart from the anode plate, one or more inner conductive plates positioned between and spaced apart from the anode plate and the cathode plate, and a sleeve surrounding the anode plate, the cathode plate, and the one or more inner conductive plates. A system for producing chlorine bleach includes, in addition to the electrolysis apparatus, a container having an opening and which is configured to hold a solution of water and salt. The system further includes a power source having a first terminal connected to the anode plate and a second terminal connected to the cathode plate. Upon connecting the anode plate and the cathode plate to the power source and inserting the electrolysis apparatus into the solution, electrolysis of the solution produces chlorine bleach.

18 Claims, 4 Drawing Sheets

ELECTROLYSIS APPARATUS, SYSTEM, AND METHOD FOR PRODUCING CHLORINE BLEACH

CROSS-REFERENCE TO RELATED APPLICATIONS

The present application claims priority to U.S. Patent Application Ser. No. 62/489,788 filed on Apr. 25, 2017, the entire disclosure of which is incorporated herein by reference.

BACKGROUND OF THE INVENTION

The present invention pertains to an electrolysis apparatus, system, and method for producing chlorine bleach.

In many parts of the world, particularly in developing countries that lack basic resources, such as clean drinking water and reliable electricity, sanitation is often difficult. Chlorine bleach (aqueous sodium hypochlorite), which can be used to kill pathogens in water and to clean clothes and other goods, is often expensive to transport to remote locations because of its weight, which is primarily water weight. Even concentrated bleach is largely water but poses additional dangers due to its high concentration of chemicals. For example, one gallon of bleach of any concentration can weigh eight pounds or more, including packaging. Because it is utilized for so many purposes, a remote location may need hundreds of gallons on hand, which can be costly to transport.

SUMMARY OF THE INVENTION

The present invention is an electrolysis apparatus, system, and method for producing chlorine bleach.

An electrolysis apparatus made in accordance with the present invention includes an anode plate, a cathode plate spaced apart from the anode plate, one or more inner conductive plates positioned between and spaced apart from the anode plate and the cathode plate, and a sleeve surrounding the anode plate, the cathode plate, and the one or more inner conductive plates. The anode plate and the cathode plate are connected to the terminals of a power source, such as a 12-V car battery, by respective wires.

In some embodiments, the anode plate, the cathode plate, and the one or more inner conductive plates are substantially parallel to one another and are substantially the same size.

In some embodiments, there are two inner conductive plates which are equally spaced between the anode plate and the cathode plate. In one exemplary embodiment, the two inner conductive plates are equally spaced about 0.3125 inches between the anode plate and the cathode plate, such that anode plate and the cathode plate are spaced about 0.9375 inches apart. The inner conductive plates are not connected to power source, nor connected directly to the anode plate or the cathode plate. Rather, one or more combs are attached to at least one of the anode plate, the cathode plate, and the one or more inner conductive plates, and the one or more combs maintain spacing between the anode plate, the cathode plate, and the one or more inner conductive plates.

In some embodiments, the inner conductive plates include notches on each side, and the combs are positioned in the aligned notches on either side of the inner conductive plates, such that, when assembled, the top of each of the combs is positioned below the lower surface of anode plate, and the bottom of each of the combs is positioned above the upper surface of the cathode.

In some embodiments, each of the combs defines two slots, which allow the combs to engage the edges of the respective inner conductive plates. Specifically, when assembled, a portion of the first inner conductive plate is inserted into a slot of each comb, and a portion of the second inner conductive plate is inserted into another slot of each comb. The combs thus prevent the anode plate, the cathode plate, and the inner conductive plates from coming into contact with one another.

In some embodiments, the electrolysis apparatus further includes one or more posts extending through holes defined in the anode plate, the cathode plate, and the one or more inner conductive plates. Such posts improve structural stability and hold the components together.

As mentioned above, the anode plate, the cathode plate, and the inner conductive plates are surrounded by a sleeve. The sleeve is comprised of a non-reactive material that is both non-conductive and corrosion-resistant, such as high-density polyethylene (HDPE) or a similar thermoplastic. In operation, the sleeve is subjected to both an electric current, as well as corrosive liquid, i.e., water that includes both bleach and salt. Thus, the sleeve is constructed of a material that is durable in harsh conditions. Furthermore, the sleeve includes a plurality of openings that allow liquid to enter and circulate through the sleeve.

An exemplary system for producing chlorine bleach made in accordance with the present invention further includes a jerry can or similar container having an opening and configured to hold a solution of water and salt (i.e., a saline solution). The system further includes a power source, such as a 12-V car battery.

The sleeve of the exemplary electrolysis apparatus is sized to fit into the opening of the jerry can or similar container. To this end, in some embodiments of the present invention, a collar is assembled around the electrolysis apparatus and is screwed onto the jerry can to secure the electrolysis apparatus in position.

In an exemplary method for producing chlorine bleach in accordance with the present invention, in a first step, a jerry can or other similar container is filled with a solution of water and salt (i.e., a saline solution). In particular, the jerry can is filled with a predetermined volume of water and a predetermined amount of salt, which are then mixed within the jerry can to produce a saline solution. In one particular implementation, about five liters of water are mixed with about 350 milliliters of salt.

After filling the jerry can with the saline solution, in a second step, the electrolysis apparatus is inserted into opening of the jerry can until the sleeve is at least partially submerged in the solution.

Next, the electrolysis apparatus is connected to the power source (such as a 12-V car battery). In particular, a first wire is used to connect the anode plate to the first (positive) terminal of the power source, and a second wire is used to connect the cathode plate to the second (negative) terminal of the power source. Once the electrolysis apparatus is connected to the battery, over time, the saline solution is converted into chlorine bleach.

DETAILED DESCRIPTION OF THE INVENTION

An electrolysis apparatus for producing chlorine bleach made in accordance with the present invention produces a chlorine bleach (aqueous sodium hypochlorite) concentrate that meets the World Health Organization's (WHO) standard for disinfection in a medical setting. Chlorine bleach is the WHO's recommended disinfectant to stop the spread of many infectious diseases, including Ebola. Furthermore, chlorine bleach is the most commonly used disinfectant in the world, making it ideal because it is both effective and versatile. The chlorine bleach that is produced with the electrolysis apparatus of the present invention may be utilized to disinfect household items, such as clothing and cooking utensils, as well as surfaces for food preparation, medical purposes, and other surfaces. Potable (or drinking) water can also be dosed with small amounts of the chlorine bleach to kill parasites and bacteria in the water, allowing for clean potable (or drinking) water in remote locations.

Furthermore, the electrolysis apparatus of the present invention is easily portable, safe, and effective for use in remote locations and relies on the use of only a few commonly available resources. Specifically, in at least one exemplary implementation, and as further described below, the electrolysis apparatus of the present invention allows for production of approximately one gallon of chlorine bleach in a short period of time (e.g., approximately an hour), utilizing available water, common table salt (sodium chloride), and a power source (e.g., a 12-V car battery). The water can be sourced locally, and thus does not need to be shipped long distances (as would be the case with shipping bleach). Salt may also be readily available, but if not, shipping salt is much cheaper than shipping a liquid due to its lower weight. Finally, 12-V car batteries are often used in remote locations as power sources and can be used with the electrolysis apparatus of the present invention. Indeed, such 12-V car batteries can be used while installed or temporarily removed from vehicles. Thus, the entire electrolysis apparatus is small enough to fit into a backpack and weighs less than five pounds (i.e., less than a gallon of bleach).

The electrolysis apparatus of the present invention utilizes electrolysis to make chlorine bleach, preferably at about 0.5 percent concentration, which is the recommended concentrate suggested by the WHO for medical applications. By producing bleach at a known concentration, the electrolysis apparatus allows producers to know exactly how much to dilute the product. This lessens the possibility of over-dilution or under-dilution of the bleach. A test kit is preferably used to verify the proper concentration.

Figure 1:
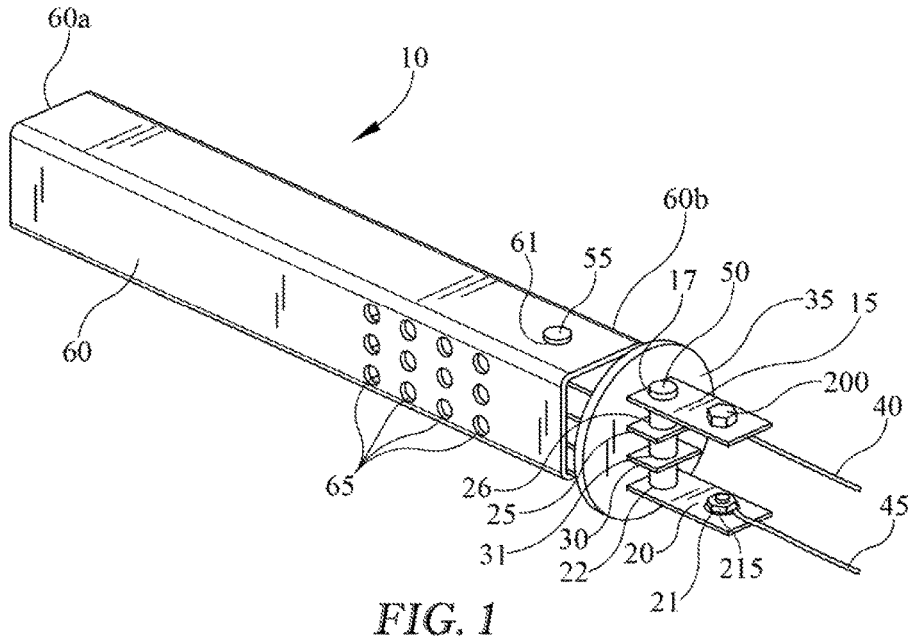
FIG. 1 is a perspective view of an exemplary electrolysis apparatus for producing chlorine bleach made in accordance with the present invention.
Figure 2:
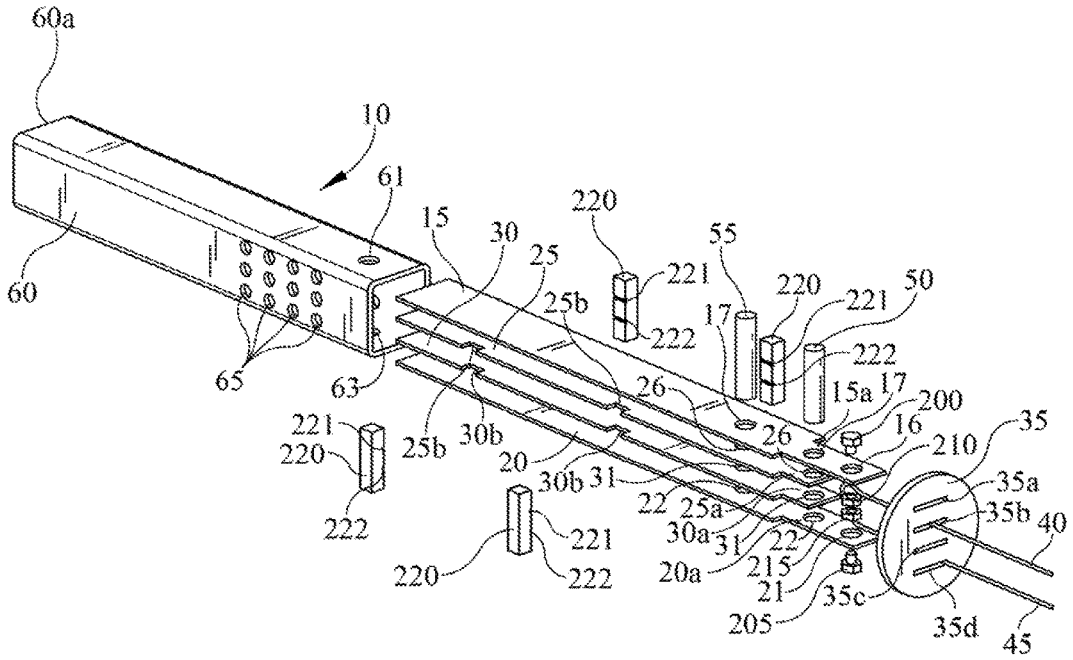
FIG. 2 is an exploded perspective view of the electrolysis apparatus of FIG. 1.
Figure 6:
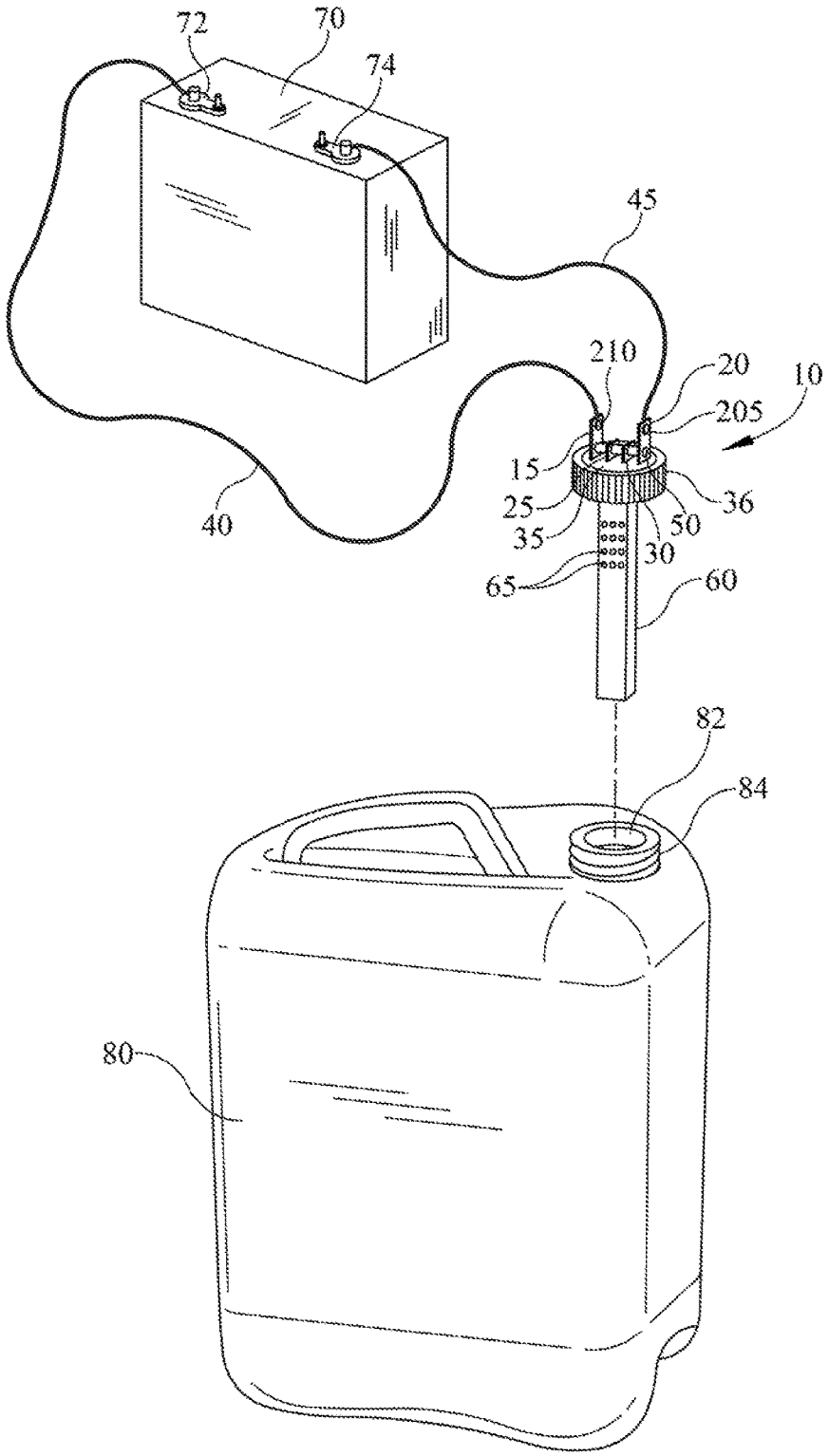
FIG. 6 is a perspective view of an exemplary system for producing chlorine bleach made in accordance with the present invention, including the electrolysis apparatus of FIG. 1 connected to a power source (battery) and configured for insertion into a container.

Referring now to FIGS. 1, 2, and 6, an exemplary electrolysis apparatus 10 for producing chlorine bleach made in accordance with the present invention includes an anode plate 15, a cathode plate 20, and a sleeve 60. In use, and as shown in FIG. 6, the anode plate 15 and the cathode plate 20 are connected to the terminals of a power source 70 (such as a 12-V car battery) by respective wires 40, 45. Specifically, as shown in FIG. 6, the anode plate 15 is connected to a first (positive) terminal 72 of the power source 70 by the first wire 40, and the cathode plate 20 is connected to a second, or negative, terminal 74 of the power source 70 by the second wire 45.

Figure 3:
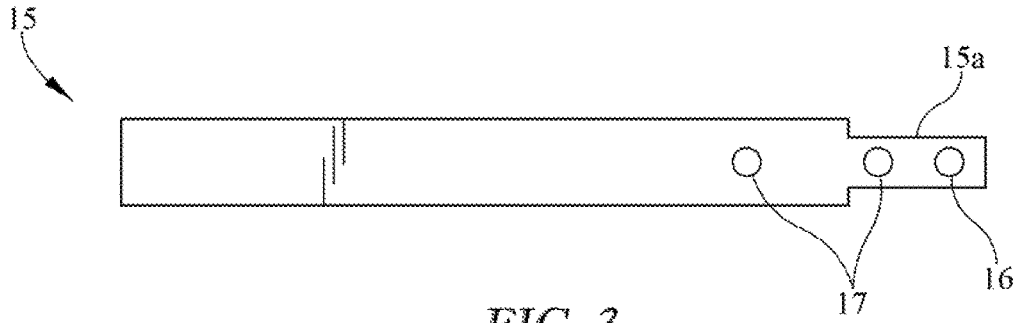
FIG. 3 is a plan view of the anode plate of the electrolysis apparatus of FIG. 1.

FIG. 3 is a plan view of the anode plate 15 in this exemplary embodiment. As shown, the anode plate 15 is substantially rectangular with a narrower tongue 15*a* at one end of the anode plate 15. In this exemplary embodiment, the anode plate 15 is about 0.94 inches wide, and the tongue 15*a* is about 0.58 inches wide. Furthermore, the anode plate 15 is about 9.5 inches long, with the tongue 15*a* being about 1.5 inches long, and the remainder of the anode plate 15 being about 8.0 inches long. As shown in FIGS. 1 and 2, the anode plate 15 is substantially flat, with a thickness of about 0.04 inches in this exemplary embodiment. Finally, in this exemplary embodiment, the anode plate 15 defines several holes 16, 17, the importance of which will be described below.

Figure 4:
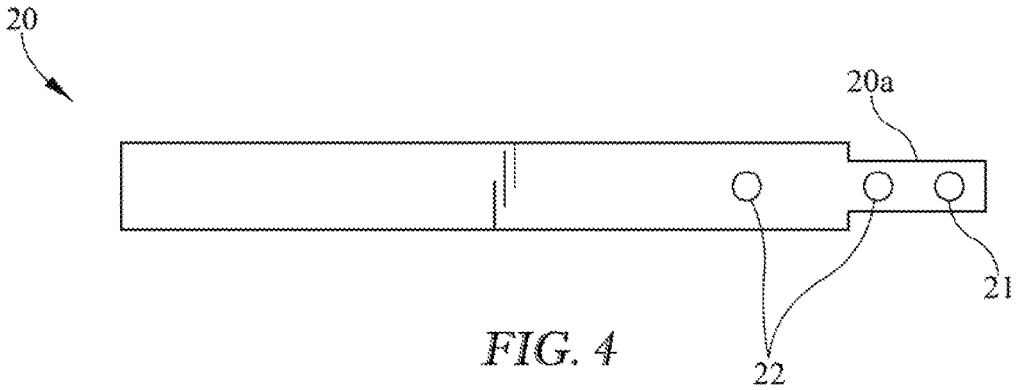
FIG. 4 is a plan view of the cathode plate of the electrolysis apparatus of FIG. 1.

FIG. 4 is a plan view of the cathode plate 20 in this exemplary embodiment. As shown, the cathode plate 20 is substantially rectangular with a narrower tongue 20*a* at one end of the cathode plate 20. In this exemplary embodiment, the cathode plate 20 is about 0.94 inches wide, and the tongue 20*a* is about 0.58 inches wide. Furthermore, the cathode plate 20 is about 9.5 inches long, with the tongue 20*a* being about 1.5 inches long, and the remainder of the cathode plate 20 being about 8.0 inches long. As shown in FIGS. 1 and 2, the cathode plate 20 is substantially flat, with a thickness of about 0.04 inches in this exemplary embodiment. The cathode plate 20 further defines several holes 21, 22, the importance of which will be described below. In short, in this exemplary embodiment, the cathode plate 20 is identical to the anode plate 15 with respect to its shape and dimensions.

The anode plate 15 and cathode plate 20 are both comprised primarily of titanium. In some embodiments, the anode plate 15 further includes a mixed metal oxide (MMO) coating comprised of one or more of ruthenium, iridium, and titanium to promote bleach formation. In some embodiments, the cathode plate 20 is sand-blasted and acid washed, rather than including a mixed metal oxide (MMO) coating.

Referring again to FIGS. 1 and 2, the exemplary electrolysis apparatus 10 also includes first and second inner conductive plates 25, 30 positioned between the anode plate 15 and the cathode plate 20.

Figure 5:
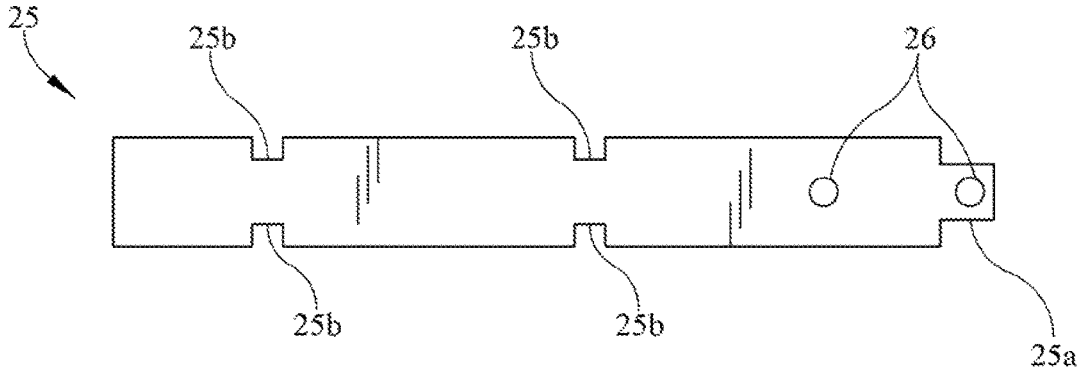
FIG. 5 is a plan view of one of the inner conductive plates of the electrolysis apparatus of FIG. 1.

FIG. 5 is a plan view of the first inner conductive plate 25 (which is identical to the second inner conductive plate 30) in this exemplary embodiment. As shown, the first inner conductive plate 25 is substantially rectangular with a narrower tongue 25*a* at one end of the first inner conductive plate 25. In this exemplary embodiment, the first inner conductive plate 25 is about 1.0 inches wide, and the tongue 25*a* is about 0.58 inches wide. Furthermore, the first inner conductive plate 25 is about 8.52 inches long, with the tongue 25*a* being about 0.52 inches long, and the remainder of the first inner conductive plate 25 being about 8.0 inches long. As shown in FIGS. 1 and 2, the first inner conductive plate 25 is substantially flat, with a thickness of about 0.04 inches in this exemplary embodiment. Finally, in this exemplary embodiment, the first inner conductive plate 25 defines several notches 25*b* along the edges of the first inner conductive plate 25, as well as several holes 26, the importance of which will be described below.

As mentioned above, in this exemplary embodiment, the first and second inner conductive plates 25, 30 are identical. In other words, the second inner conductive plate 30 is substantially rectangular with a narrower tongue 30*a* at one end of the second inner conductive plate 30. In this exemplary embodiment, the second inner conductive plate 30 is about 1.0 inches wide, and the tongue 30*a* is about 0.58 inches wide. Furthermore, the second inner conductive plate 30 is about 8.52 inches long, with the tongue 30*a* being about 0.52 inches long, and the remainder of the second inner conductive plate 30 being about 8.0 inches long. As shown in FIGS. 1 and 2, the second inner conductive plate 30 is substantially flat, with a thickness of about 0.04 inches in this exemplary embodiment. Finally, in this exemplary embodiment, the second inner conductive plate 30 further defines several notches 30*b* along the edges of the second inner conductive plate 30, as well as several holes 31, in the same manner as the first inner conductive plate 25 shown in FIG. 5, the importance of which will be described below.

The inner conductive plates 25, 30 are comprised primarily of titanium. In some embodiments, one or both of the inner conductive plates 25, 30 further includes a mixed metal oxide (MMO) coating comprised of one or more of ruthenium, iridium, and titanium to promote bleach formation.

Referring once again to FIGS. 1 and 2, the inner conductive plates 25, 30 are not connected to the power source 70, nor connected directly to the anode plate 15 or the cathode plate 20. As best shown in FIG. 2, in this exemplary embodiment, the inner conductive plates 25, 30 include notches 25*b*, 30*b* on each side, although only one side is visible in FIG. 2. Combs 220 are positioned in the aligned notches 25*b*, 30*b* on either side of the inner conductive plates 25, 30, such that, when assembled, the top of each of the combs 220 is positioned below the lower surface of anode plate 15, and the bottom of each of the combs 220 is positioned above the upper surface of the cathode plate 20. In other words, the combs 220 are positioned between the anode plate 15 and the cathode plate 20.

Referring still to FIGS. 1 and 2, the combs 220, however, are attached to the inner conductive plates 25, 30. In particular, in this exemplary embodiment, each of the combs 220 defines two slots 221, 222, which allow each comb 220 to engage the edges of the respective inner conductive plates 25, 30. Specifically, when assembled, a portion of the first inner conductive plate 25 on the inner edge of the notch 25*b* is inserted into the slot 221 of each comb 220, and a portion of the second inner conductive plate 30 on the inner edge of the notch 30*b* is inserted into the slot 222 of each comb 220. The combs 220 therefore prevent the anode plate 15, the cathode plate 20, and the inner conductive plates 25, 30 from coming into contact with one another. In this exemplary embodiment, the combs 220 maintain the anode plate 15, the cathode plate 20, and the inner conductive plates 25, 30 at substantially equal intervals of 0.3125 inches from one another. The combs 220 are comprised of a non-reactive and non-conducting material, such as high-density polyethylene (HDPE) or a similar thermoplastic. Of course, other configurations and compositions of the combs 220 are possible so long as the combs 220 maintain the spacing between the anode plate 15, the cathode plate 20, and the inner conductive plates 25, 30 and prevent them from coming into contact with one another.

With respect to the use of the inner conductive plates 25, 30, is it believed that the chemical reaction that produces bleach is most effective at 3-4 V. By using the inner conductive plates 25, 30, the voltage supplied by the power source 70 (i.e., 12-V car battery) is effectively reduced from 12V to about 4V. Specifically, adding the first inner conductive plate 25 and the second inner conductive plate 30 between the anode plate 15 and the cathode plate 20 results in three spaces between the anode plate 15 and the cathode plate 20. The configuration effectively divides the 12V from the power source 70 to about 4V, so that the electrolysis apparatus 10 is operating in the optimal range.

Furthermore, it should be recognized that each of the inner conductive plates 25, 30 can be characterized as an anode on one side and a cathode on the other side. Specifically, the first inner conductive plate 25 that is closest to the anode plate 15 is a cathode on the side that faces the anode plate 15, and is an anode on the side that faces the second inner conductive plate 30. Similarly, the second inner conductive plate 30 that is closest to the cathode plate 20 is an anode on the side that faces the cathode plate 20, and is a cathode on the side that faces the first inner conductive plate 25.

Referring again to FIG. 2, in addition to the combs 220, in this exemplary embodiment, the electrolysis apparatus 10 includes posts 50, 55, with each post passing through one of the holes 17 defined through the anode plate 15, one of the holes 26 defined through the first inner conductive plate 25, one of the holes 31 defined through the second inner conductive plates 30, and one of the holes 22 defined through the cathode plate 20. The posts 50, 55 thus improve structural stability. The posts 50, 55 are also comprised of a non-reactive and non-conducting material to prevent flow of current directly between the anode plate 15 and the cathode plate 20, such as low-density polyethylene (LDPE) or a similar thermoplastic. Furthermore, the posts 50, 55 preferably are mushroomed (or have an enlarged head) at each end in order to effectively hold the components together.

Referring again to FIGS. 1 and 2, the anode plate 15, the cathode plate 20, and the inner conductive plates 25, 30 are surrounded by a sleeve 60. The sleeve 60 is comprised of a non-reactive material that is both non-conductive and corrosion-resistant, such as high-density polyethylene (HDPE) or a similar thermoplastic. In operation, the sleeve 60 is subjected to both an electric current, as well as corrosive liquid, i.e., water that includes both bleach and salt. Thus, the sleeve 60 is constructed of a material that is durable in harsh conditions. Furthermore, the sleeve 60 includes a plurality of openings 65 that allow liquid to enter and circulate through the sleeve 60. In this exemplary embodiment, the distal end 60*a* of the sleeve 60 is also open to facilitate liquid flow to and around the anode plate 15, the cathode plate 20, and the inner conductive plates 25, 30 when the electrolysis apparatus 10 is submerged, as further described below.

As shown in FIGS. 1 and 2, the sleeve 60 further defines upper and lower holes 61, 63 to accommodate the post 55. In particular, as shown in FIG. 1, the post 55 passes not only through the anode plate 15, the cathode plate 20, and the inner conductive plates 25, 30, but further passes through the upper and lower holes 61, 63 defined through the sleeve 60, effectively securing the anode plate 15, the cathode plate 20, and the inner conductive plates 25, 30 within the sleeve 60, while also providing additional support for the anode plate 15, the cathode plate 20, and the inner conductive plates 25, 30 within the sleeve 60.

Referring still to FIGS. 1 and 2, in this exemplary embodiment, an end plate 35 is provided near the proximal end 60*b* of the sleeve 60. The end plate 35 includes four slots 35*a-d* that allow for the tongue 15*a* of the anode plate 15, the tongue 20*a* of the cathode plate 20, and the respective tongues 25*a*, 30*a* of the inner conductive plates 25, 30 to penetrate the end plate 35. Upon insertion of the tongues 15*a*, 20*a*, 25*a*, 30*a*, through the end plate 35, the remainder of the plates 15, 20, 25, 30 extend into the sleeve 60 at substantially the same length of about 8.0 inches. Furthermore, and as best shown in FIG. 1, the tongue 15*a* of the anode plate 15 and the tongue 20*a* of the cathode plate 20 each extend further through the end plate 35 than the tongues 25*a*, 30*a* of the inner conductive plates 25, 30, thus facilitating connection to the power source 70, as further described below.

In this exemplary embodiment, and referring still to FIG. 2, a screw 200 passes through the hole 16 defined through the anode plate 15 and is secured by a nut 210. The first wire 40 is secured between the nut 210 and the lower surface of the anode plate 15, and the nut 210 is tightened to secure the first wire 40 in place. Similarly, a screw 205 passes through the hole 21 defined through the cathode plate 20 and is secured by a nut 215. The second wire 45 is secured between the nut 215 and the upper surface of the cathode plate 20, and the nut 215 is tightened to secure the second wire 45 in place. Of course, this is just one example of how the wires 40, 45 could be electrically connected to the anode plate 15 and the cathode plate 20, and other configurations of components could be used to complete this electrical connection without departing from the spirit and scope of the present invention.

Referring now to FIG. 6, in some embodiments, the electrolysis apparatus 10 is part of a system that also includes (i) a jerry can 80 or similar container configured to store a predetermined volume of water and a predetermined amount of salt; and (ii) a power source 70, such as a 12-V car battery.

As shown in FIG. 6, the jerry can 80 has an opening 82, and the sleeve 60 of the electrolysis apparatus 10 is sized to fit into the opening 82. Furthermore, in this exemplary embodiment, the electrolysis apparatus 10 is secured in the opening 82 through the use of a collar 36. The collar 36 is assembled around the electrolysis apparatus 10, engaging the end plate 35 along its periphery. The collar 36 also has internal threads (not shown) for mating with external threads 84 on the jerry can 80, much in the same manner that a spout or lid is secured to a jerry can 80. Thus, the collar 36 can be screwed onto the jerry can 80 to secure the electrolysis apparatus 10 in position.

Figure 7:
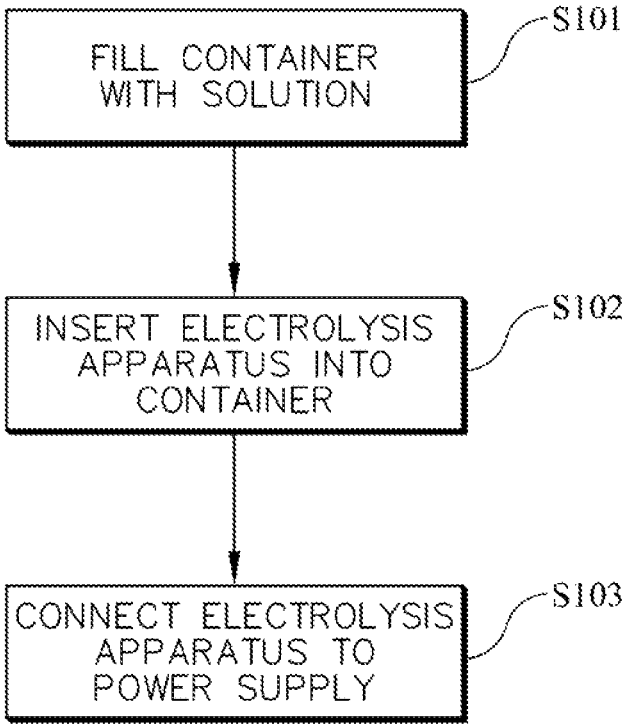
FIG. 7 is a process flow diagram for an exemplary method for producing chlorine bleach in accordance with the present invention.

Referring now to FIG. 7, in an exemplary method for producing chlorine bleach in accordance with the present invention, in a first step S101, a jerry can 80 or similar container is filled with a solution of water and salt. In particular, the jerry can 80 is filled with a predetermined volume of water and a predetermined amount of salt, which are then mixed within the jerry can 80 to produce a saline solution. In one particular implementation, about five liters of water are mixed with about 350 milliliters of salt.

After filling the jerry can 80 with the saline solution, in a second step S102, the electrolysis apparatus 10 is inserted into opening 82 of the jerry can 80 until the sleeve 60 is at least partially submerged in the solution. As described above, the collar 36, which is assembled around the electrolysis apparatus 10, engaging the end plate 35 along its periphery, can then be screwed onto the jerry can 80 to secure the electrolysis apparatus 10 in position.

Next, in a step S103, the electrolysis apparatus 10 is connected to the power source 70. In particular, the first wire 40 is used to connect the anode plate 15 to the first (positive) terminal 72 of the power source 70, and the second wire 45 is used to connect the cathode plate 20 to the second (negative) terminal 74 of the power source 70. Once the electrolysis apparatus 10 is connected to the power source 70, over time, the saline solution is converted into chlorine bleach. In particular, it is contemplated that, in the method of the present invention, after an extended period of time, the chlorine bleach stabilizes at about 0.5 percent concentration. In other words, chemical equilibrium is reached at this concentration, and additional time where the electrolysis apparatus 10 is connected to the power source 70 does not result in a higher concentration.

One of ordinary skill in the art will recognize that additional embodiments and implementations are possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. An electrolysis apparatus for producing chlorine bleach, comprising:

an anode plate;

a cathode plate spaced apart from the anode plate;

one or more inner conductive plates positioned between and spaced apart from the anode plate and the cathode plate;

a sleeve surrounding the anode plate, the cathode plate, and the one or more inner conductive plates; and one or more combs attached to at least one of the anode plate, the cathode plate, and the one or more inner conductive plates, each of the one or more combs positioned and extending between the anode plate and the cathode plate, thus maintaining spacing between the anode plate, the cathode plate, and the one or more inner conductive plates;

wherein, upon connecting the anode plate and the cathode plate to a power source and inserting the electrolysis apparatus into a solution of water and salt, electrolysis of the solution produces chlorine bleach.

2. The electrolysis apparatus of claim 1, wherein the anode plate and the cathode plate are spaced apart about 0.9375 inches.

3. The electrolysis apparatus of claim 1, wherein the one or more inner conductive plates are substantially equally spaced between the anode plate and the cathode plate.

4. The electrolysis apparatus of claim 1, wherein there are two inner conductive plates positioned between and spaced apart from the anode plate and the cathode plate.

5. The electrolysis apparatus of claim 4, wherein the one or more inner conductive plates are spaced apart about 0.3125 inches.

6. The electrolysis apparatus of claim 1, wherein the anode plate, the cathode plate, and the one or more inner conductive plates are substantially parallel to one another.

7. The electrolysis apparatus of claim 1, wherein the anode plate, the cathode plate, and the one or more inner conductive plates are substantially the same size.

8. The electrolysis apparatus of claim 1, wherein the one or more combs are attached to each of the one or more inner conductive plates.

9. The electrolysis apparatus of claim 8, wherein each comb defines one or more slots, with each of the one or more inner conductive plates inserted into one of the one or more slots of the comb.

10. The electrolysis apparatus of claim 1, and further comprising one or more posts extending through holes defined in the anode plate, the cathode plate, and the one or more inner conductive plates.

11. An electrolysis apparatus for producing chlorine bleach, comprising:

an anode plate;

a cathode plate spaced apart from the anode plate;

one or more inner conductive plates positioned between and spaced apart from the anode plate and the cathode plate; and a sleeve surrounding the anode plate, the cathode plate, and the one or more inner conductive plates; and one or more combs attached to at least one of the anode plate, the cathode plate, and the one or more inner conductive plates, the one or more combs maintaining spacing between the anode plate, the cathode plate, and the one or more inner conductive plates;

wherein each inner conductive plate of the one or more inner conductive plates defines notches along edges of the inner conductive plate for receiving one of the one or more combs, and wherein, upon connecting the anode plate and the cathode plate to a power source and inserting the electrolysis apparatus into a solution of water and salt, electrolysis of the solution produces chlorine bleach.

12. An electrolysis apparatus for producing chlorine bleach, comprising:

an anode plate;

a cathode plate spaced apart from and substantially parallel to the anode plate;

one or more inner conductive plates positioned between and spaced apart from the anode plate and the cathode plate;

a sleeve that surrounds the anode plate, the cathode plate, and the one or more inner conductive plates;

one or more posts, wherein each of the one or more posts extends through respective openings defined through each of the anode plate, the cathode plate, and the one or more inner conductive plates, and wherein, upon connecting the anode plate and the cathode plate to a power source and inserting the electrolysis apparatus into a solution of water and salt, electrolysis of the solution produces chlorine bleach.

13. The electrolysis apparatus of claim 12, wherein the one or more inner conductive plates comprises two inner conductive plates that are substantially equally spaced about 0.3125 inches between the anode plate and the cathode plate, such that the anode plate and the cathode plate are spaced apart about 0.9375 inches.

14. A system for producing chlorine bleach, comprising:

a container having an opening and configured to hold a solution of water and salt;

a power source having a first terminal and a second terminal;

an electrolysis apparatus, including an anode plate connected to the first terminal of the power source, a cathode plate spaced apart from the anode plate and connected to the second terminal of the power source, one or more inner conductive plates positioned between and spaced apart from the anode plate and the cathode plate, and a sleeve surrounding the anode plate, the cathode plate, and the one or more inner conductive plates; and a collar adapted to removably secure the electrolysis apparatus to the container;

wherein, in use, the electrolysis apparatus is inserted into the solution of water and salt through the opening in the container to initiate electrolysis of the solution and to produce chlorine bleach.

15. The system of claim 14, wherein the power source is a 12-V battery, and the voltage applied across the solution is about 4 V.

16. The system of claim 14, wherein the container includes a first set of threads and the collar includes a second set of threads compatible with the first set of threads.

17. A method for producing chlorine bleach, comprising the steps of:

filling a container with a solution of water and salt;

inserting an electrolysis apparatus into the container to at least partially submerge the electrolysis apparatus in the solution, the electrolysis apparatus having a first end and a second end, and including an anode plate extending in a first direction from the first end to the second end, a cathode plate spaced apart from the anode plate and extending in the first direction from the first end to the second end, one or more inner conductive plates positioned between and spaced apart from the anode plate and the cathode plate, each of the one or more inner conductive plates extending in the first direction from the first end to the second end, and a sleeve surrounding the anode plate, the cathode plate, and the one or more inner conductive plates, the sleeve including a sidewall that defines a plurality of openings configured to allow the solution to enter the sleeve in a second direction that is substantially perpendicular to the first direction;

connecting the anode plate of the electrolysis apparatus to a first terminal of a power source; and connecting the cathode plate of the electrolysis apparatus to a second terminal of the power source, thereby initiating electrolysis and producing chlorine bleach.

18. The method of claim 17, wherein the container is filled with about five liters of water and about 350 milliliters of salt.

* * * * *